United States Patent [19]

Simmons

[11] Patent Number: 4,682,792

[45] Date of Patent: Jul. 28, 1987

[54] BINDER FOR ARTICLES SUCH AS BOOKS AND CASSETTES

[76] Inventor: Graham Simmons, 13, Oriole Way, Larkfield, Maidstone, Kent ME20 6LN, England

[21] Appl. No.: 849,987

[22] Filed: Apr. 10, 1986

[30] Foreign Application Priority Data

Apr. 11, 1985 [GB] United Kingdom ..... 8509281

[51] Int. Cl.[4] ..... B42D 17/00; B42D 3/12; B42D 5/00; B42F 7/00

[52] U.S. Cl. ..... 281/45; 281/20; 281/46; 402/46

[58] Field of Search ..... 281/15 B, 16, 21 R, 281/23, 45, 49, 47, 48, 20; 402/66, 52, 54, 68, 46; 24/67.3, 33 C, 346

[56] References Cited

U.S. PATENT DOCUMENTS 4,402,530 9/1983 Daguerre ..... 281/45
4,486,032 12/1984 Leahy ..... 281/45
4,521,035 6/1985 Berezowsky ..... 281/48
4,524,992 6/1985 Linn ..... 281/45
4,569,613 2/1986 Thomas ..... 281/45

*Primary Examiner*—Paul A. Bell
*Assistant Examiner*—Paul M. Heyrana
*Attorney, Agent, or Firm*—William A. Drucker

[57] ABSTRACT

A binder, particularly for use with paper-back books, video cassettes and other parallelepipedal objects, has a front wall and two spaced rearward side walls which, when unconstrained, are convergent but capable of being sprung further apart, each side wall having externally a recess bounded by a shoulder, the respective shoulders of the two side walls facing in opposite directions such that when a plurality of the binders are placed side by side in a row the shoulder of one such binder can abut against the shoulder of the next such binder to locate the binders in alignment.

7 Claims, 5 Drawing Figures

BINDER FOR ARTICLES SUCH AS BOOKS AND CASSETTES

This invention relates to the provision of a binder to serve for the protection, and improvement of appearance, of generally rectangular parallelepipedal articles and, whilst not restricted solely to such use, is primarily of utility in the enclosing of paper-back books and video cassettes and the like.

There is currently a very large demand in commerce for books in paper-back form, particularly in view of production costs; but paper-back books suffer from well-known disadvantages that the covers tend to assume rapidly a worn appearance, and the books are often non-selfsupporting, particularly after a short period of use, so that it is no longer possible to place them in neat rows on a bookshelf or other surface without providing some form of lateral support such as book ends or the like.

OBJECT OF THE INVENTION

It is the object of the present invention to provide an improved binder, for articles such as paper-back books, which is such that when a plurality of the binders are placed in a row, they interact to facilitate their retention in alignment.

SUMMARY

According to the present invention a binder comprises a front wall and two side walls extending from the front wall rearwardly thereof at spaced positions, the two side walls being, when unconstrained, convergent towards their free edges and being capable of springing further apart, each side wall having externally thereon a recess bounded by a shoulder, the respective shoulders of the two side walls facing in opposite directions such that when a plurality of the binders are placed side by side in a row the shoulder of one such binder can abut against the shoulder of the next such binder to locate the binders in alignment.

In a preferred arrangement, the shoulders are each positioned at or adjacent to where the respective side wall joins to the front wall. The recess and shoulder may advantageously be formed in a zone of the side wall which is thicker than the remainder of the side wall.

The recess and shoulder are preferably formed along the entire height of the side wall.

Conveniently, the front wall and the two side walls form an integral whole, and the front wall may be thicker than the two side walls, and may be outwardly curved to better simulate the spine of a book. To permit springing apart of the side walls, preferably the front wall and the two side walls are resiliently deformable.

Advantageously the two side walls are provided on their inwardly-facing surface with grip-enhancing means to hold firmly an article placed between the walls. Such grip-enhancing means may be gripper relief formations, such as at least one rib disposed longitudinally of the side wall.

There may optionally be provided, for or as part of, the binder, a separable side cover for loose assembly with a side wall at the inner side thereof, the side cover and the side wall having interacting respective tenon and recess formations for locating the side cover in a predetermined position relative to the side wall. Such a cover may be provided at one or both sides of the article to be enclosed, and may comprise a substantially plane sheet of material which is disposed between the inner face of the side wall and the adjacent outer face of the article to be enclosed. In a convenient construction, the side wall has a locating tenon at or near its free edge, and the side cover has a corresponding recess to receive the tenon.

Preferably the cross-sections of the binder and of the side cover are unvaried along their height dimension, whereby both items are then adapted to be manufactured by extrusion. Thus, both items may be produced by parting off suitable lengths from an extrusion of a stiff but suitably resiliently deformable plastics material.

To enhance the appearance of the binder, decoration may be applied to the exposed surface, and particularly on or along the exposed outer surface of the front wall, e.g. by a known heat-embossing process.

In order that the nature of the invention may be readily ascertained, an embodiment of binder in accordance therewith is hereinafter particularly described with reference to the figures of the accompanying drawing.

DESCRIPTION OF THE PREFERRED EMBODIMENT

Figure 1:
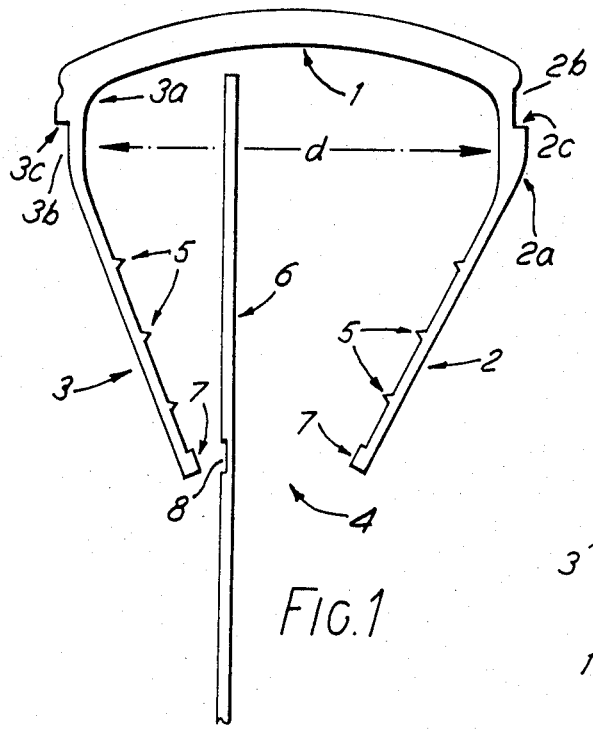
FIG. 1 is a plan view of a binder, and of a separate side cover for use with the binder.
Figure 2:
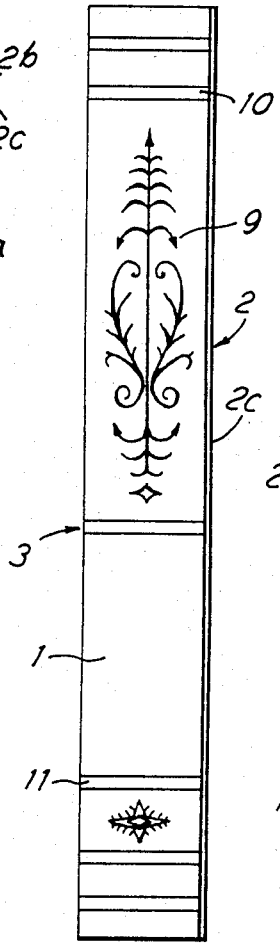
FIG. 2 is a front elevation of the binder.
Figure 3:
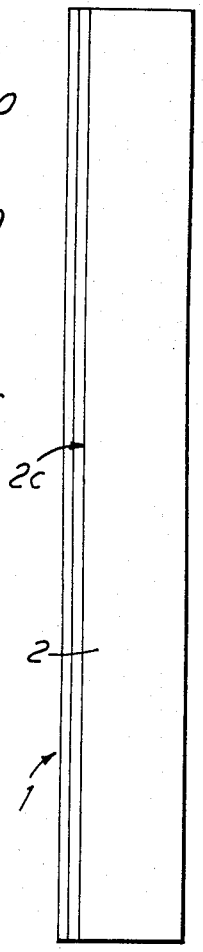
FIG. 3 is a side elevation of the binder.
Figure 5:
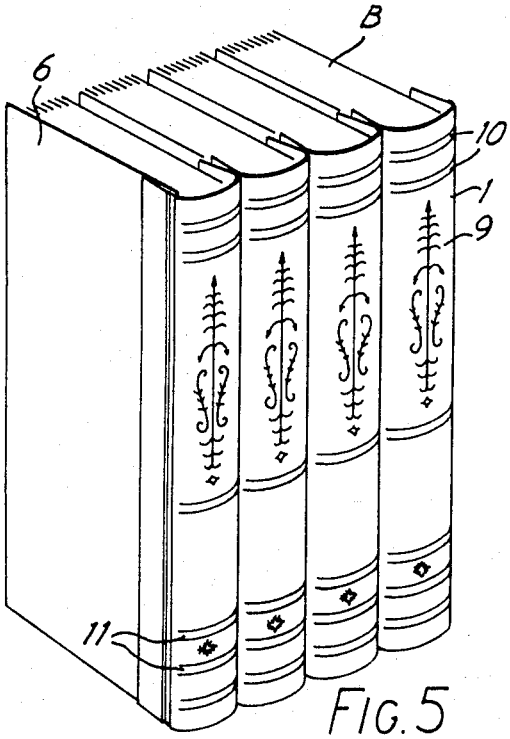
FIG. 5 is a perspective view to show the general frontal appearance of the assembly of FIG. 4.

Referring to FIG. 1, the binder comprises a front wall 1, and two side walls 2 and 3. The front wall 1 is generally of somewhat greater thickness than the side walls 2 and 3, and preferably is curved as shown to simulate the usual spine of a book-back. Where the side wall 2 merges into the front wall 1 it has a somewhat thicker zone 2*a* within which is formed a recess 2*b* bounded by a shoulder surface 2*c*, the purpose of which is explained below. Where the side wall 3 merges into the front wall 1 it also has a somewhat thicker zone 3*a* within which is formed a recess 3*b* bounded by a shoulder 3*c*. The shoulders 2*c* and 3*c* face in opposite directions.

The side walls 2 and 3, in unconstrained condition, are convergent so that the gap 4 between their free edges is considerably less than the dimension "d". The front wall and the side walls are made of a resiliently deformable material, and this permits the free edges of the side walls 2 and 3 to be forced apart by hand to permit an object, such as a paper-back book "B" or a video cassette, to be introduced between the side walls 2 and 3 and to become gripped between those walls. To enhance the grip of the side walls 2 and 3 on the article placed between them, the side walls may be provided with gripping ribs 5.

To cooperate, if desired, with the binder there may be provided the separate side cover 6 which is a generally plane rectangular sheet of a suitable stiff material. Where the binder is to be used on a single book which is to stand alone, say on a shelf, the appearance of the whole, and the grip on the book, can be improved by placing a side cover 6 at both sides of the book, within the respective side wall 2 or 3.

To retain the separable side cover(s) 6 in correct position with respect to the binder, the side walls 2 and 3 of the binder may be provided with respective tenons 7, and the side covers 6 may have a corresponding recess 8 to receive the tenon and locate the two members together.

Figure 4:
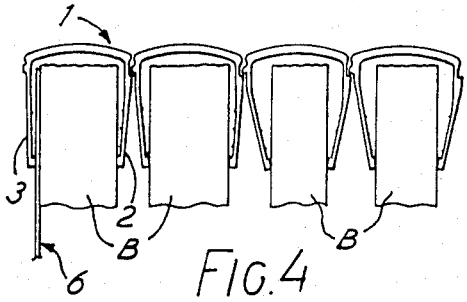
FIG. 4 is a plan view of a plurality of binders each engaged on a paper-back book, and with a side cover in position.

FIG. 4 shows how a plurality of the binders may be placed about a plurality of paper-back books B. When the assembly is placed on a support, e.g. a shelf of a bookcase, the binders can be pushed laterally into a closely abutting position, as seen in FIG. 4, in which each shoulder 3*c* at one side of the binder abuts squarely against the shoulder 2*c* of the next binder. This serves to keep the entire row of binders aligned longitudinally to give a very neat appearance of the row as a whole.

FIG. 4 shows a side cover 6 fitted only on the exposed side of one end binder of the row of binders. Another such side cover would be placed in the binder at the other end of the row, or alternatively each binder could have a pair of side covers 6 included with it.

The front wall 1, side walls 2 and 3, their recesses and shoulders, the ribs 5, and the tenons 7, are all of unvaried cross-section, i.e. the recesses and shoulders, ribs, and tenons all extend longitudinally for the whole vertical height of the binder. This construction thus permits the binders to be manufactured as individual lengths cut off from an extrusion of constant cross-section and indeterminate length. The binder is accordingly particularly suitable for manufacture from an extrudable resilient material such as a suitably stiff synthetic resinous plastics material. Likewise, the side cover 6, with its recess 8, is of unvaried cross-section and can be cut from a length of extrusion of indeterminate length.

The exposed surface of the front wall 1 of the binder is shown with decoration 9, and markings 10, 11, which help to simulate the appearance of books. The decoration and markings can readily be applied, by a heat-embossing process, at intervals on the extruded material, or may be applied onto the cut lengths of extrusion after parting off.

I claim:

1. A binder, to embrace and grip an article such as a book or cassette, comprising a resiliently-bendable generally planar front wall of width greater than that of the article to be embraced, two integral resiliently-bendable side walls extending rearwardly each from a respective lateral extremity of the front wall, said side walls being when unconstrained convergent towards their free edges, one said side walls having formed within the thickness thereof an external recess bounded by a plane inward-facing shoulder facing in the direcition of the free ends of said side walls, the other said side wall having formed within the thickness thereof an external recess bounded by a plane outward-facing shoulder facing in the direction of said front wall, said shoulders generally and substantially co-planar with said front wall and at the same spacing from a line of join of the respective side wall and the front wall, whereby a first such binder may be moved relative to a second such binder in a direction perpindicular to the plane of the front wall so as to cause the inward facing shoulder of the first such binder to abut the outward facing shoulder of the second such binder and locate the binders in alignment in a linear row.

2. A binder, as claimed in claim 1, wherein each said shoulder is positioned adjacent to where the respective side wall joins to the front wall.

3. A binder, as claimed in claim 1, wherein said recess and shoulder are formed in a zone of the side wall which is thicker than the remainder of the side wall.

4. A binder, as claimed in claim 1, wherein the front wall is thicker than the two side walls.

5. A binder, as claimed in claim 1, wherein the side walls are provided on their inwardly facing surface with grip-enhancing means.

6. A binder, as claimed in claim 5, wherein said grip-enhancing means are constituted by at least one rib disposed longitudinally of the side wall.

7. A binder, as claimed in claim 1, further comprising a separable side cover for loose assembly with a side wall at the inner side thereof, the side cover and the side wall having interacting respective tenon and recess formations for locating the side cover in a predetermined position relative to the side wall.

* * * * *